US006713949B2

(12) United States Patent
Fukushima et al.

(10) Patent No.: US 6,713,949 B2
(45) Date of Patent: Mar. 30, 2004

(54) SHORT ARC TYPE ULTRA-HIGH PRESSURE DISCHARGE LAMP

(75) Inventors: Kensuke Fukushima, Hyogo (JP); Tetu Okamoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/270,540

(22) Filed: Oct. 16, 2002

(65) Prior Publication Data

US 2003/0094899 A1 May 22, 2003

(30) Foreign Application Priority Data

Oct. 17, 2001 (JP) ..... 2001-318859

(51) Int. Cl.[7] ..... H01J 17/20

(52) U.S. Cl. ..... 313/332; 313/570; 313/574; 313/631; 313/623

(58) Field of Search ..... 313/332, 570, 313/574, 623, 626, 631

(56) References Cited

U.S. PATENT DOCUMENTS 5,387,839 A * 2/1995 Giordano et al. ..... 313/623
5,877,590 A 3/1999 Fukuyo et al.
5,993,279 A * 11/1999 Fukyyo et al. ..... 445/26
6,411,037 B1 * 6/2002 Ohkawa et al. ..... 313/623

FOREIGN PATENT DOCUMENTS

GB 1 521 129 8/1978
GB 2045741 A 11/1980
JP 11-135066 5/1999

* cited by examiner

*Primary Examiner*—Ashok Patel
(74) *Attorney, Agent, or Firm*—Oblon, Spivak, McClelland, Maier & Neustadt, P.C.

(57) ABSTRACT

The present invention is a short arc type ultra-high pressure discharge lamp in which a pair of electrodes 3 are disposed inside an arc tube 1 that comprises quartz glass, seal portions 2 are formed that comprise quartz glass and extend to both sides of the arc tube 1, and at least 0.15 mg/mm$^3$ of mercury is filled into the arc tube 1, wherein a metal foil 4 is embedded in each of the seal portions 2, and metal granular lumps 6 are protrusively provided on surfaces of each metal foil 4.

3 Claims, 5 Drawing Sheets

SHORT ARC TYPE ULTRA-HIGH PRESSURE DISCHARGE LAMP

BACKGROUND OF THE INVENTION

1. Field of the Invention

The present invention relates to a short arc type ultra-high pressure discharge lamp used as a light source for a projection apparatus that uses a microdevice mirror or a liquid crystal display apparatus.

2. Description of the Related Art

Good color rendition and high brightness are required of light sources for projection apparatuses that use microdevice mirrors and liquid crystal display apparatuses.

To improve color rendition, metal halide lamps filled with various light-emitting metals were used in the past, but in recent years there have been demands for lamps that have both yet better color rendition and yet higher brightness, and hence short arc type ultra-high pressure discharge lamps that utilize the vapor pressure of mercury and have a very high pressure inside the arc tube have come to be used.

FIG. 5 shows such a short arc type ultra-high pressure discharge lamp.

The short arc type ultra-high pressure discharge lamp comprises a quartz glass arc tube 1, and quartz glass seal portions 2 that are formed on both sides of the quartz glass arc tube 1; a pair of electrodes 3 are disposed opposite one another inside the arc tube 1.

A metal foil 4 is connected to one end of each electrode 3, with the metal foil 4 and part of the electrode 3 being hermetically embedded in the respective seal portion 2.

Moreover, an external lead rod 5 is connected to each metal foil 4, with the external lead rod 5 extending out to the outside from the respective seal portion 2.

The inside of the arc tube 1 is filled with at least 0.15 $mg/mm^3$ of mercury.

By filling with at least 0.15 $mg/mm^3$ of mercury in this way, when the lamp is turned on, the mercury vaporizes inside the arc tube to an extremely high pressure of $1.5\times10^7$ Pa or more, whereby spreading of the arc is suppressed, and hence good color rendition and high brightness are realized.

However, with such a short arc type ultra-high pressure discharge lamp, there has been a problem that the pressure inside the arc tube 1 becomes extremely high when the lamp is turned on, and the phenomenon of 'foil floating' thus occurs in which the metal foil 4 embedded in each seal portion 2 breaks away from the quartz glass constituting the seal portion 2, and hence the seal portion 2 is damaged.

The reason for this is that the molybdenum foil constituting the metal foil 4 and the quartz glass have a different expansion coefficient to one another, and hence tiny gaps are formed between the metal foil 4 and the quartz glass constituting the seal portion 2 during manufacture; the gas at extremely high pressure inside the arc tube 1 flows into these gaps, and thus stress is generated that forces the metal foil 4 and the quartz glass apart.

Furthermore, because the molybdenum foil constituting the metal foil 4 and the quartz glass have a different expansion coefficient to one another, when the lamp is turned on the metal foil becomes hot and tries to expand, but the quartz glass does not expand so much; this difference in forces is manifested as thermal stress, and hence cracks may arise, or microcracks in the seal portion 2 that arise during the manufacturing process may be caused to grow, thus damaging the seal portion 2.

SUMMARY OF THE INVENTION

The present invention has been produced to resolve problems such as the above, and it is an object thereof to provide a short arc type ultra-high pressure discharge lamp according to which seal portions are not damaged even if the pressure inside the arc tube becomes high.

A short arc type ultra-high pressure discharge lamp defined in claim 1 is a short arc type ultra-high pressure discharge lamp in which a pair of electrodes are disposed inside an arc tube that comprises quartz glass, seal portions are formed that comprise quartz glass and extend to both sides of the arc tube, and at least 0.15 $mg/mm^3$ of mercury is filled into the arc tube; wherein a metal foil, and part of each electrode connected to this metal foil, are embedded in each of the seal portions, and metal granular lumps are protrusively provided on surfaces of the metal foil embedded in each of the seal portions.

A short arc type ultra-high pressure discharge lamp defined in claim 2 is the short arc type ultra-high pressure discharge lamp according to claim 1, wherein the metal granular lumps comprise any one of tungsten, tungsten compounds, molybdenum, molybdenum compounds, and compounds of tungsten and molybdenum.

A short arc type ultra-high pressure discharge lamp defined in claim 3 is the short arc type ultra-high pressure discharge lamp according to claim 2, wherein the granular lumps have a thickness in a range of 0.001 to 1 $\mu$m, and the granular lumps cover the metal foils at a coverage of not more than 80%.

DESCRIPTION OF SYMBOLS

Figure 1:
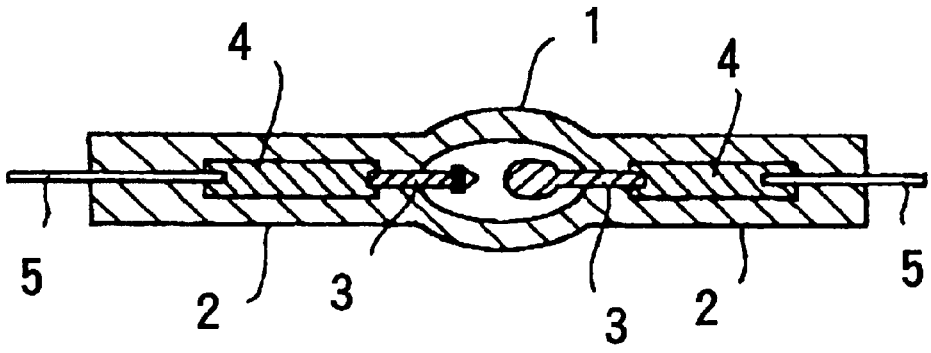
FIG. 1 is an explanatory view of a short arc type ultra-high pressure discharge lamp of the present invention.

1 arc tube
2 seal portion
3 electrode
4 metal foil
5 external lead rod
6 granular lump
7 base metal article

DESCRIPTION OF THE PREFERRED EMBODIMENTS

FIG. 1 shows a discharge lamp of the present invention.

The short arc type ultra-high pressure discharge lamp comprises a quartz glass arc tube 1, and quartz glass seal portions 2 that are formed on both sides of the quartz glass arc tube 1; a pair of electrodes 3 are disposed opposite one another inside the arc tube 1.

A metal foil 4 is connected to one end of each electrode 3, with the metal foil 4 and part of the electrode 3 being hermetically embedded in the respective seal portion 2.

Moreover, an external lead rod 5 is connected to each metal foil 4, with the external lead rod 5 extending out to the outside from the respective seal portion 2.

The metal foils 4 are molybdenum foil, and have a length of 11 mm, a width of 1.5 mm, and a thickness of 20 $\mu$m.

The inside of the arc tube 1 is filled with at least 0.15 mg/mm$^3$ of mercury, in the present embodiment 0.28 mg/mm$^3$ of mercury.

As a result, when the lamp is turned on, the mercury vapor pressure inside the arc tube 1 becomes $1.6\times10^7$ Pa, i.e. the pressure inside the arc tube becomes extremely high, and hence spreading of the arc is suppressed, and thus good color rendition and high brightness can be realized.

Figure 2:
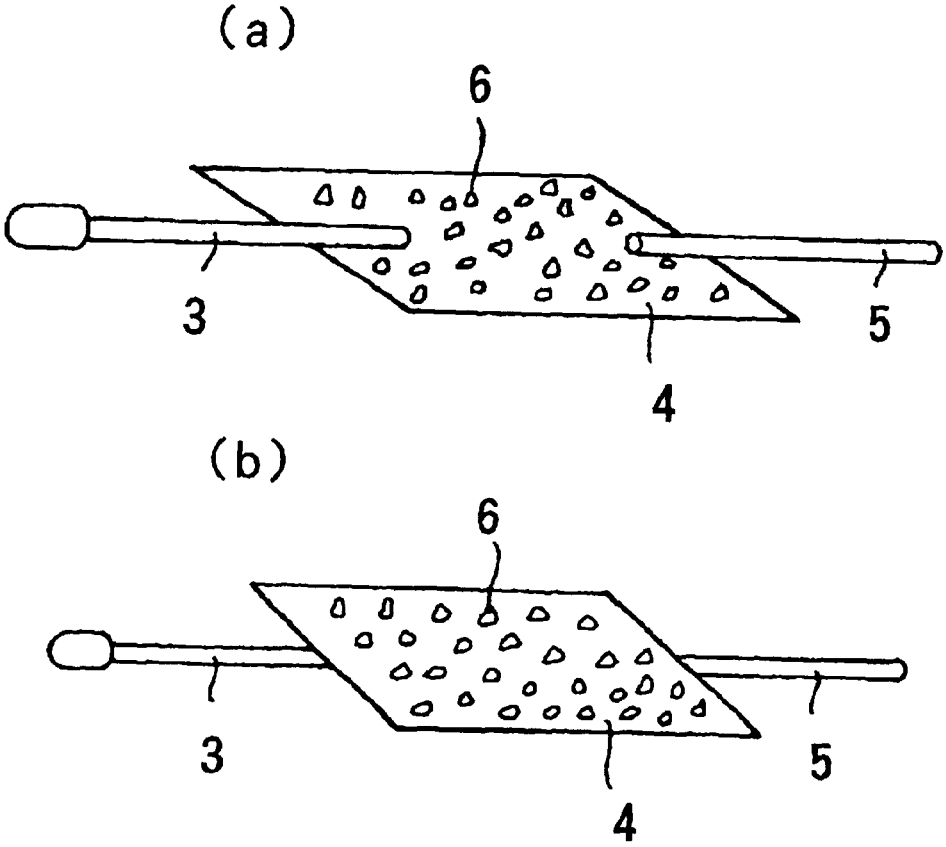
FIG. 2 consists of explanatory views of a metal foil of the short arc type ultra-high pressure discharge lamp of the present invention.

As shown in FIG. 2, tungsten granular lumps 6 are protrusively provided on the surfaces of each metal foil 4. FIG. 2(*a*) shows the state of the front surface of the metal foil 4, and FIG. 2(*b*) shows the state of the rear surface of the metal foil.

Figure 3:
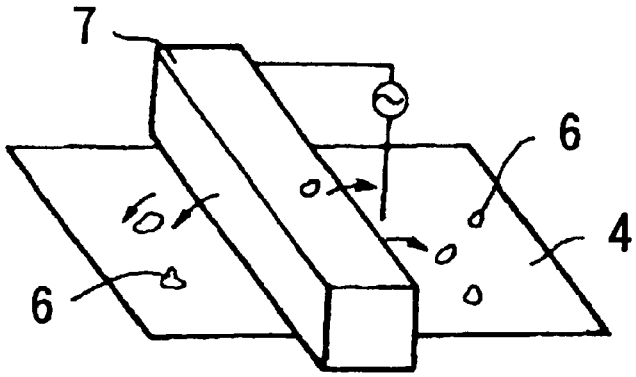
FIG. 3 is an explanatory view of manufacture of granular lumps.

As shown in FIG. 3, the granular lumps 6 can be manufactured, for example, by applying a high voltage between the metal foil 4 and a base metal article 7 that will produce the granular lumps in a state in which the base metal article 7 is placed in contact with the metal foil 4, whereby the base metal article 7 becomes hot, and part thereof scatters and attaches at high temperature onto the metal foil 4.

By making the base metal article 7 be tungsten, when a voltage is applied to the tungsten, part of the tungsten scatters and attaches at high temperature onto the metal foil 4. When the tungsten attaches at high temperature onto the metal foil 4 in this way, the respective materials undergo alloying, and hence granular lumps 6 can be protrusively provided on the metal foil 4 firmly.

Furthermore, in the case that the base metal article is made to be molybdenum, the granular lumps will be molybdenum. Moreover, in the case that the base metal article is made to be a compound of tungsten and molybdenum, the granular lumps will be a compound of tungsten and molybdenum.

The above operation is normally carried out in an air atmosphere, and hence the granular lumps become a tungsten oxide, a molybdenum oxide, or an oxide of tungsten and molybdenum.

Moreover, if the above operation is carried out in a nitrogen atmosphere, then the granular lumps will become a tungsten nitride, a molybdenum nitride, or a nitride of tungsten and molybdenum.

Furthermore, if the above operation is carried out in an Ar atmosphere, then the granular lumps will become pure tungsten, pure molybdenum, or a pure compound of tungsten and molybdenum.

As the method of manufacturing the granular lumps, the granular lumps can similarly be produced using vapor deposition or sputtering instead.

Note that in FIGS. 2 and 3, to make the granular lumps easy to see, the granular lumps have intentionally been drawn larger than they really are.

The reason for making the granular lumps 6 be tungsten, a tungsten compound, molybdenum, a molybdenum compound, or a compound of tungsten and molybdenum in this way is that the materials constituting the lamp are tungsten for the electrodes, quartz glass for the arc tube and the seal portions, molybdenum for the metal foils, and tungsten or molybdenum for the external lead rods, and if a material other than these is used for the granular lumps, then there may be adverse effects on the lamp. To eliminate adverse effects on the lamp, a material constituting the lamp is thus used for the granular lumps 6, i.e. tungsten, a tungsten compound, molybdenum, a molybdenum compound, or a compound of tungsten and molybdenum.

Figure 4:
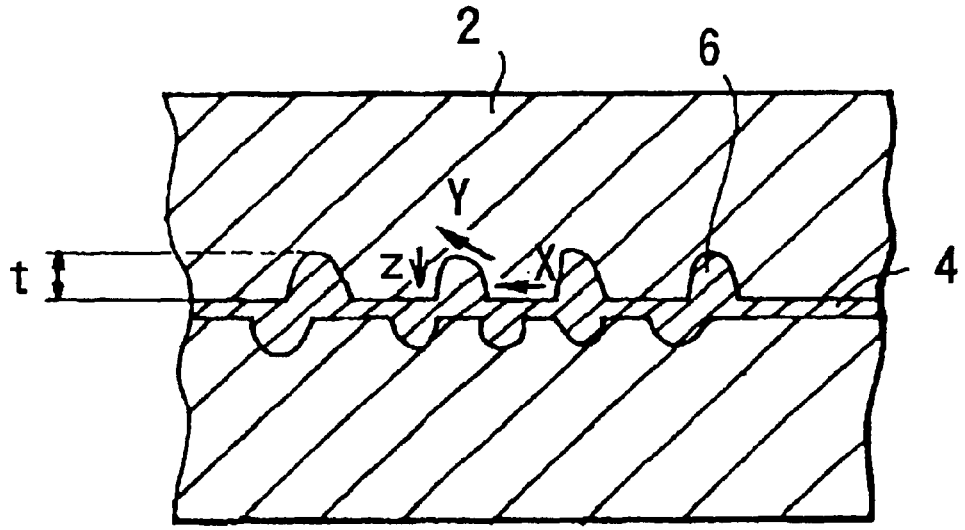
FIG. 4 is an enlarged sectional view showing the state of sealing between a metal foil on which granular lumps have been protrusively provided and quartz glass of a seal portion.
Figure 5:
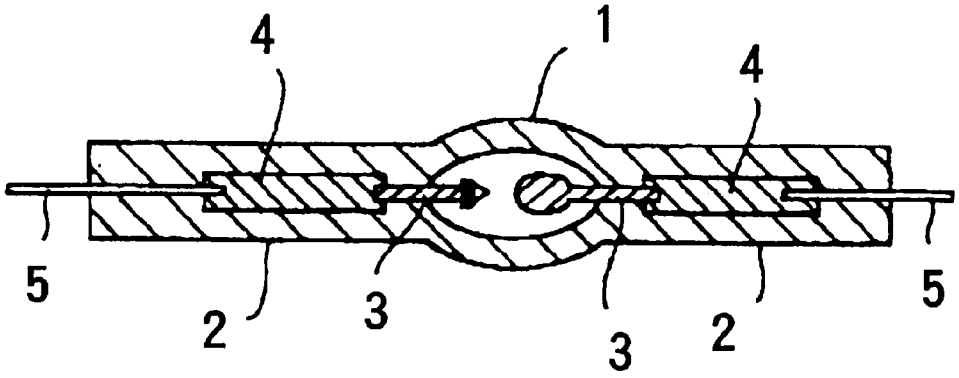
FIG. 5 is an explanatory view of a conventional short arc type ultra-high pressure discharge lamp.

FIG. 4 is an enlarged sectional view showing the state of sealing between the metal foil 4 on which the granular lumps 6 have been protrusively provided and the quartz glass of the seal portion 2.

As can be seen from FIG. 4, because the granular lumps 6 are protrusively provided on the surfaces of the metal foil 4, the state is such that the granular lumps 6 and the quartz glass constituting the seal portion 2 interlock with one another, and hence the granular lumps 6 have an anchoring effect; even if the inside of the arc tube 1 becomes at a high pressure and thus gas in a high-pressure state flows into gaps between the metal foil 4 and the quartz glass, the quartz glass will not be forced apart from the metal foil 4. That is, the phenomenon of 'foil floating' will not occur.

Furthermore, even if thermal stress arises due to the difference in expansion coefficient between the metal foil 4 and the quartz glass, because the granular lumps 6 are protrusively provided, and the state is such that the granular lumps 6 and the quartz glass interlock with one another, the direction in which the stress acts can be made random, for example the X-direction, the Y-direction and the Z-direction as shown in FIG. 4, and hence the stresses acting in the various directions will cancel one another out; overall, the thermal stress can thus be relaxed, and hence cracks can be prevented from arising. Furthermore, even if microcracks are present in the seal portions 2 through manufacture, these microcracks will not grow.

As a result, even if the pressure inside the arc tube 1 becomes high, the phenomenon of foil floating will not occur, and hence the seal portions 2 will not be damaged.

Next, short arc type ultra-high pressure discharge lamps having the basic structure shown in FIG. 1 were prepared, with whether or not there were granular lumps on the metal foils and the material from which the granular lumps were formed if present being changed, and the thickness of the granular lumps and the coverage of the granular lumps being varied; for the lamps of these cases, tests were carried out in which the state of the seal portions after repeatedly turning the lamp on and off was studied.

In the present application, the thickness of the granular lumps is the distance t from the surface of the metal foil 4 to the top of the granular lumps 6 as shown in FIG. 4.

Moreover, in the present application, the coverage is taken as the value of S2/S1×100 (%), wherein S1 is the surface area of the metal foil 4 (the total area of the front surface and the rear surface) as shown in FIG. 2, and S2 is the total area of all of the regions where protrusively provided granular lumps 6 are in contact with the surfaces (front surface and rear surface) of the metal foil 4.

Note that the formation of the granular lumps was carried out in an air atmosphere, a nitrogen atmosphere or an Ar atmosphere, and the repeated turning on and of f was a mode in which there were 10 repetitions of 2 minutes on and 40 seconds off.

The test results are shown in Table 1-1 and Table 1-2 (hereinafter described as Table 1). Table 1 shows data obtained by studying the seal portion state for different granular lumps protrusively provided on the metal foil.

In Table 1, regarding the granular lumps, for example the '$O_x$' of '$WO_x$' indicates an oxide, and the '$N_x$' of '$WN_x$' indicates a nitride.

As can be seen from Table 1, with all of the comparative lamps 19 to 22, for which there were no granular lumps on the surfaces of the metal foils, foil floating or rupture of the seal portions occurred.

With comparative lamp 2, comparative lamp 5, comparative lamp 8, comparative lamp 10, comparative lamp 12, comparative lamp 14, comparative lamp 15, and comparative lamp 18, for which the coverage was 80% or more, the seal portions ruptured.

This is because, if the coverage is 80% or more, then the proportion of the surfaces of the metal foil occupied by the granular lumps becomes high, and hence the surfaces of the metal foil on which the granular lumps are formed become flat; the anchoring effect of the granular lumps thus becomes small, and hence foil floating occurs, and as the foil floating progresses, the seal portion ruptures.

With comparative lamp 4, comparative lamp 6, comparative lamp 11, and comparative lamp 17, for which the thickness of the granular lumps was 0.00 $\mu$m or less, foil floating occurred in the seal portions.

This is because, if the thickness of the granular lumps is 0.00 $\mu$m or less, then the anchoring effect of the granular lumps becomes small, and hence the quartz glass constituting the seal portion breaks away from the metal foil, and thus foil floating occurs.

With comparative lamp 1, comparative lamp 3, comparative lamp 7, comparative lamp 9, and comparative lamp 16, for which the thickness of the granular lumps was 1 $\mu$m or more, foil floating occurred in the seal portions, or the seal portions ruptured.

This is because, if the thickness of the granular lumps is 1 $\mu$m or more, then the granular lumps are too big, and hence the volume of the metal foil as a whole including the granular lumps increases; the thermal stress thus becomes too high, and hence the stress generated becomes bigger than the proportion of the stress absorbed through the granular lumps; foil floating thus occurs, and as the foil floating progresses, the seal portion ruptures.

On the other hand, with working example lamps 1 to 21, the coverage of the granular lumps was 80% or less, and the thickness of the granular lumps was in a range of 0.001 to 1 $\mu$m; foil floating thus did not occur in the seal portions, and hence the seal portions were not damaged. In Table 1, the state of the seal portions of the lamps is recorded as being 'good'.

TABLE 1-1

| | Atomosphere when forming granular lumps | Material from which granular lumps formed | Granular lumps | Thickness of granular lumps ($\mu$/m) | Coverage of granular lumps (%) | State of seal portions |
|---|---|---|---|---|---|---|
| Working example lamp 1 | Air | W | WOx | 0.5 | 10 | Good |
| Working example lamp 2 | Air | W | WOx | 0.2 | 30 | Good |
| Working example lamp 3 | Air | W | WOx | 0.05 | 0.02 | Good |
| Working example lamp 4 | N2 | W | WNx | 0.1 | 20 | Good |
| Working example lamp 5 | N2 | W | WNx | 0.8 | 40 | Good |
| Working example lamp 6 | Ar | W | W | 0.02 | 15 | Good |
| Working example lamp 7 | Ar | W | W | 0.002 | 75 | Good |
| Working example lamp 8 | Air | Mo | MoOx | 0.5 | 10 | Good |
| Working example lamp 9 | Air | Mo | MoOx | 0.1 | 50 | Good |
| Working example lamp 10 | Air | Mo | MoOx | 0.9 | 0.5 | Good |
| Working example lamp 11 | N2 | Mo | MoNx | 0.5 | 70 | Good |
| Working example lamp 12 | N2 | Mo | MoNx | 0.2 | 25 | Good |
| Working example lamp 13 | Ar | Mo | Mo | 0.001 | 80 | Good |
| Working example lamp 14 | Ar | Mo | Mo | 0.03 | 65 | Good |
| Working example lamp 15 | Air | W/Mo(=0.1) | W-Mo-Ox | 0.4 | 0.1 | Good |
| Working example lamp 16 | Air | W/Mo(=0.5) | W-Mo-Ox | 0.2 | 0.05 | Good |
| Working example lamp 17 | Air | W/Mo(=0.9) | W-Mo-Ox | 0.8 | 20 | Good |
| Working example lamp 18 | N2 | W/Mo(=0.5) | W-Mo-Nx | 0.6 | 15 | Good |
| Working example lamp 19 | N2 | W/Mo(=0.5) | W-Mo-Nx | 0.1 | 1 | Good |
| Working example lamp 20 | Ar | W/Mo(=0.5) | W-Mo | 0.04 | 50 | Good |
| Working example lamp 21 | Ar | W/Mo(=0.5) | W-Mo | 0.002 | 70 | Good |

TABLE 1-2

| | Atmosphere when forming granular lumps | Material from which granular lumps formed | Granular lumps | Thickness of granular lumps ($\mu$/m) | Coverage of granular lumps (%) | State of seal portions |
|---|---|---|---|---|---|---|
| Comparative lamp 1 | Air | W | WOx | 1.5 | 10 | Rupture |
| Comparative lamp 2 | Air | W | WOx | 0.5 | 85 | Rupture |
| Comparative lamp 3 | N2 | W | WNx | 2.2 | 5 | Rupture |
| Comparative lamp 4 | N2 | W | WNx | 0.001 or less | 1 | Foil floating |
| Comparative lamp 5 | Ar | W | W | 0.05 | 92 | Foil floating |
| Comparative lamp 6 | Ar | W | W | 0.001 or less | 50 | Foil floating |
| Comparative lamp 7 | Air | Mo | MoOx | 2 | 5 | Foil floating |
| Comparative lamp 8 | Air | Mo | MoOx | 1 | 90 | Rupture |
| Comparative lamp 9 | N2 | Mo | MoNx | 2.5 | 15 | Foil floating |
| Comparative lamp 10 | N2 | Mo | MoNx | 0.2 | 95 | Rupture |
| Comparative lamp 11 | Ar | Mo | Mo | 0.001 or less | 40 | Foil floating |
| Comparative lamp 12 | Ar | Mo | Mo | 0.1 | 100 | Rupture |
| Comoarative lamp 13 | Air | W/Mo(=0.1) | W-Mo-Ox | 3 | 20 | Foil floating |

TABLE 1-2-continued

| | Atmosphere when forming granular lumps | Material from which granular lumps formed | Granular lumps | Thickness of granular lumps ($\mu$/m) | Coverage of granular lumps (%) | State of seal portions |
|---|---|---|---|---|---|---|
| Comparative lamp 14 | Air | W/Mo(=0.9) | W-Mo-Ox | 0.6 | 88 | Rupture |
| Comparative lamp 15 | N2 | W/Mo(=0.5) | W-Mo-Nx | 0.2 | 95 | Rupture |
| Comparative lamp 16 | N2 | W/Mo(=0.5) | W-Mo-Nx | 5 | 5 | Rupture |
| Comparative lamp 17 | Ar | W/Mo(=0.5) | W-Mo | 0.001 or less | 25 | Foil floating |
| Comparative lamp 18 | Ar | W/Mo(=0.5) | W-Mo | 0.1 | 98 | Foil floating |
| Comparative lamp 19 | — | None | — | — | — | Foil floating |
| Comparative lamp 20 | — | None | — | — | — | Rupture |
| Comparative lamp 21 | — | None | — | — | — | Foil floating |
| Comparative lamp 22 | — | None | — | — | — | Foil floating |

According to the short arc type ultra-high pressure discharge lamp of the present invention, metal granular lumps are protrusively provided on the surfaces of the metal foil embedded in each seal portion, and hence the quartz glass constituting the seal portion does not break away from the metal foil, i.e. foil floating can be prevented, and thus the seal is not damaged.

What is claimed is:

1. A short arc type ultra-high pressure discharge lamp, in which a pair of electrodes are disposed inside an arc tube that is made of quartz glass, seal portions are formed that are made of quartz glass and extend to both sides of said arc tube, and at least 0.15 mg/mm$^3$ of mercury is filled into said arc tube;

wherein a metal foil, and part of each electrode connected to said metal foil, are embedded in each of said seal portions;

and metal granular lumps are protrusively provided on surfaces of said metal foil embedded in each of said seal portions.

2. The short arc type ultra-high pressure discharge lamp according to claim 1, wherein said metal granular lumps comprise any one of tungsten, tungsten compounds, molybdenum, molybdenum compounds, and compounds of tungsten and molybdenum.

3. The short arc type ultra-high pressure discharge lamp according to claim 2, wherein said granular lumps have a thickness in a range of 0.001 to 1 $\mu$m, and said granular lumps cover said metal foils at a coverage of not more than 80%.

* * * * *

UNITED STATES PATENT AND TRADEMARK OFFICE

CERTIFICATE OF CORRECTION

PATENT NO. : 6,713,949 B2
DATED : Marcy 30, 2004
INVENTOR(S) : Fukushima et al.

It is certified that error appears in the above-identified patent and that said Letters Patent is hereby corrected as shown below:

Title page,
Item [73], Assignee, should read
-- [73] Assignee: Ushio Denki Kabushiki Kaisya, Tokyo (JP) --

Signed and Sealed this

Twelfth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,713,949 B2
APPLICATION NO. : 10/270540
DATED : March 30, 2004
INVENTOR(S) : Fukushima et al.

It is certified that error appears in the above-identified patent and that said Letters Patent is hereby corrected as shown below:

Title page,
Item [73], Assignee, should read
-- [73] Assignee: Ushio Denki Kabushiki Kaisya, Tokyo (JP) --

This certificate supersedes Certificate of Correction issued October 12, 2004.

Signed and Sealed this

Twelfth Day of December, 2006

JON W. DUDAS
*Director of the United States Patent and Trademark Office*